United States Patent [19]

Jacobson

[11] 4,411,264

[45] Oct. 25, 1983

[54] SUPPLIED AIR RESPIRATOR

[76] Inventor: Earl B. Jacobson 510 S. Shore Dr., Crystal Lake, Ill. 60014

[21] Appl. No.: 172,425

[22] Filed: Jul. 25, 1980

[51] Int. Cl.[3] ..... A62B 7/00

[52] U.S. Cl. ..... 128/201.23; 128/201.15; 128/201.25; 55/DIG. 21; 55/276; 181/258; 181/224; 181/292

[58] Field of Search ..... 128/201.15, 201.22, 128/201.23, 201.24, 201.25, 201.28, 201.29, 202.19; 55/276, DIG. 21; 181/258, 224, 292

[56] References Cited

U.S. PATENT DOCUMENTS

| | | | |
|---|---|---|---|
| 2,896,617 | 7/1959 | Gibbons | 128/201.23 |
| 4,052,984 | 10/1977 | Brockway | 128/201.23 |
| 4,127,130 | 11/1978 | Naysmith | 128/201.25 |
| 4,207,883 | 6/1980 | Shindler | 128/201.22 |

OTHER PUBLICATIONS

Jolley, Jr. et al., "An Improved Airline-Type Supplied-Air Plastic Suit", Jun. 1978, Dupont Publication DPSPU 78-30-12.

*Primary Examiner*—Henry J. Recla
*Attorney, Agent, or Firm*—Winburn & Gray, Ltd.

[57] ABSTRACT

A supplied air respirator having a detachable air flow baffle therein, the baffle having increased air flow efficiency with a low noise operating level. The baffle is formed from a flexible plastic tubing having openings spaced laterally and circumferentially therein and having a foam layer sealingly secured there around and preferably having a cover thereover. The baffle can be formed in a partial or substantially complete loop within the respirator and is detachably secured therein with clips or loops.

4 Claims, 10 Drawing Figures

SUPPLIED AIR RESPIRATOR

BACKGROUND OF THE INVENTION

The invention relates generally to supplied air respirators and more particularly to a respirator which has a removable air baffle which increases the air flow efficiency without increasing the operating noise level of the respirator.

In various water and air borne pollutant environments, such as a nuclear, welding, fiberglass, asbestos, grain bin and other pollutant containing environments; it is desired to have the workers shielded at least from breathing or otherwise contacting the pollutants. Supplied air respirators are designed to be utilized in these environments which are non-catastropic work areas. In otherwords, the respirators are utilized to protect against the long term affects and the worker could take a failed respirator off and leave the work area without serious damage. The respirator may be a hood, full suit or other type of wearing apparel.

One type of respirator is a full face respirator which is sealingly engaged like a mask on the head of the worker to cover the facial areas including the eyes, nose and mouth. There are numerous disadvantages in using this type of mask, including: training the workers, a reduced field of vision, claustrophobia, leakage, discomfort and decontaminating and cleansing the mask each time utilized which increases costs. Further, the mask does not fit all facial sizes and shapes, especially workers with beards.

It thus would be desirable to eliminate the disadvantages of the full face respirator to increase comfort, wearability, air flow, etc. To attempt to overcome these disadvantages, hood type sypplied air respirators have been developed.

One type of hood type supplied air respirator has been developed having a foam air distribution block in the top of the hood or headpiece which includes an air supply hose sealed to the hood and secured into the air block. The air filters through the foam block at the top of the hood above the worker's head. This provides a cooler and more comfortable working environment than the full face respirator. A disadvantage of this unit is the added bulk of the foam block in the top of the hood which also does not permit the worker upward vision through the top of the hood. The block is not removable so that the respirator and air supply both must be disposed of after each contaminating use where it not possible or expedient to decontaminate the respirator. The contaminating use would be in an environment such as a radioactive environment where the outside of the hood becomes contaminated or sufficiently dirty that it cannot be reused or revitalized.

A second type of supplied air respirator with hood has a removable baffle system, but has a high back pressure which reduces the air flow efficiency of the system. NIOSH (National Institute for Occupational Safety and Health) have set standards for the operation of the respirators to supply a minimum of 6 cubic feet per miniute (cfm) of air and a maximum of 15 cfm of air and less than or equal to 80 decibels noise with an operating back pressure of 1 inch of water or less. Also the operating noise level at 15 cfm is close to the 80 decibel allowed maximum. This respirator has a baffle including a slitted tube wrapped with a gauze tape with cloth wrapped around the gauze tape. The life expectancy of the baffle is expected to be reduced since the gauze tape is affected with moisture and may loosen in use. The noise level which intially is close to the allowed maximum would appear to be increased by any loosening or other deteriation of the gauze type tape. The high back pressure appears to be caused by the tape compressing the tube slits. This is a problem where the work space or plant in which the worker is located has a low pressure air supply and the back pressure may result in the respirator air supply being below the minimum of 6 cfm.

SUMMARY OF THE INVENTION

The above and other disadvantages of prior art supplied air respirator techniques and systems are overcome in accordance with the present invention by providing an air flow baffle which is detachable therefrom allowing the respirator to be disposed and the baffle to be reused. The baffle increases the air flow efficiency of the respirator without increasing the operating noise level of the air respirator system which is about seventy decibels at 15 cfm. The baffle is formed from a tube having a plurality of openings therein with a foam cover there around.

DESCRIPTION OF THE PREFERRED EMBODIMENTS

Figure 1:
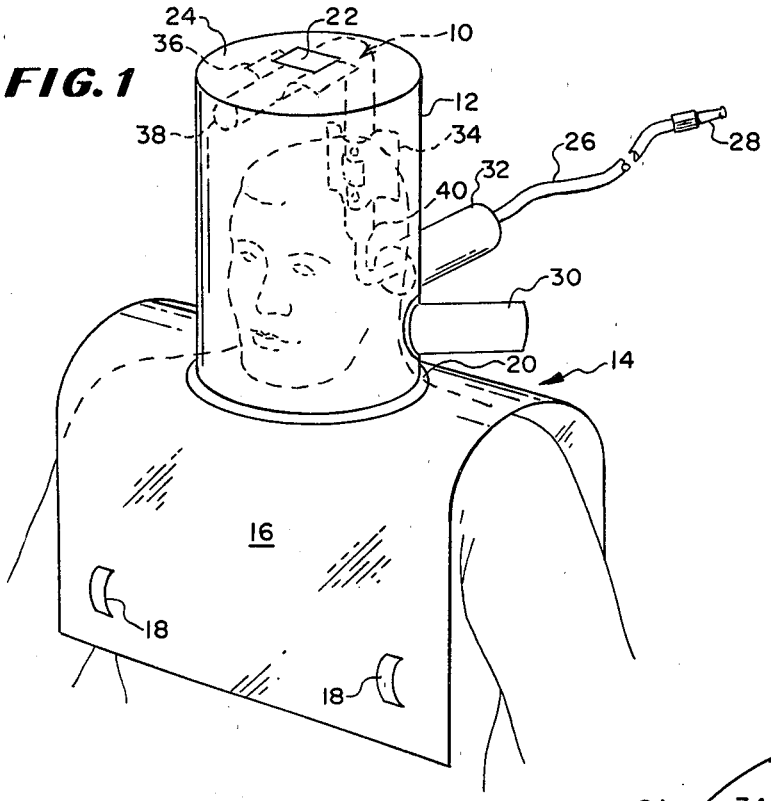
FIG. 1 is a partial perspective view of a worker in a respirator including one embodiment of the air flow baffle of the invention.

Referring to FIG. 1, an air flow baffle embodying the invention is designated generally by the reference numeral 10. The baffle 10 is secured in a hood or headpiece 12 of a hood type supplied air respirator 14. The respirator 14 includes a cape 16, preferably having an outer layer and a inner layer secured within the clothing of the worker. The cape 16 also may include a plurality of belt loops 18 through which can be secured a tether belt. The belt secures the cape around the body of the worker and restricts the air flow through the hood to provide a positive operating pressure therein. The headpiece baffle 10 also may be part of other air supplied wearing apparel.

The hood 12 is sealed to the cape 16 by glue, sewing or electronic welding at a seam 20 to form an integral body. It can have a dosimeter tab 22 secured to a top surface 24 thereof, if the respirator 14 is to be utilized in a radioactive contaminant environment. The air flow baffle 10 is supplied by an air line or tubing 26 which includes a quick connect/disconnect fitting 28 which can be engaged in the air supply outlet of the work space, plant or system. The air line 26 also may be held in the tether belt (not shown). The hood 12 may include a communication sleeve 30 in the end of which is secured a two way radio or microphone to enable the worker to communicate with those around him or outside the work space as desired.

Figure 3:
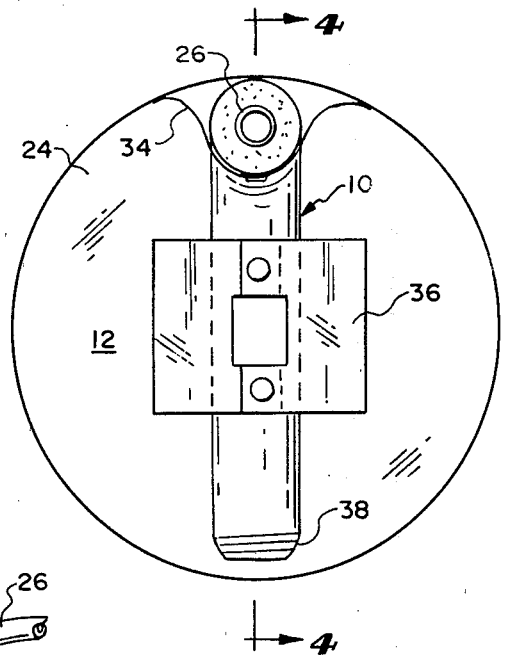
FIG. 3 is a sectional view of the hood and baffle of FIG. 2 taken along the line 3—3 therein.
Figure 2:
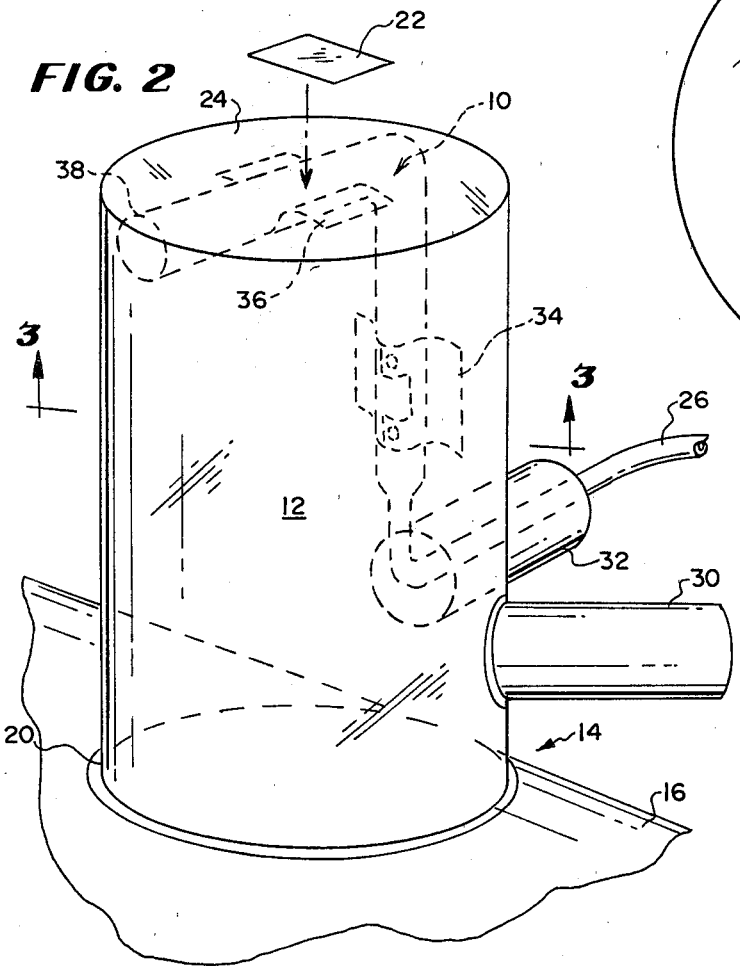
FIG. 2 is an enlarged perspective view of the hood and air flow baffle of FIG. 1.

Referring to FIGS. 2 and 3, the air flow baffle 10 is secured within a pair of snap type retainers 34 and 36 which are secured to the inner surface of the hood 12. To utilize the air flow baffle 10, the baffle 10 is inserted through the air line sleeve 32 into the interior of the hood 12 where it is secured against the surface of the hood 12 by the snap type retainers 34 and 36. When it is desired to dispose of the hood and respirator 14, the snap type retainers 34 and 36 can be unsnapped and the air line 26 is unsealed from the air line sleeve 32. The air flow baffle 10 then is removed and inserted into another respirator where it may be reused saving a considerable amount of money in using the respirators.

Figure 4:
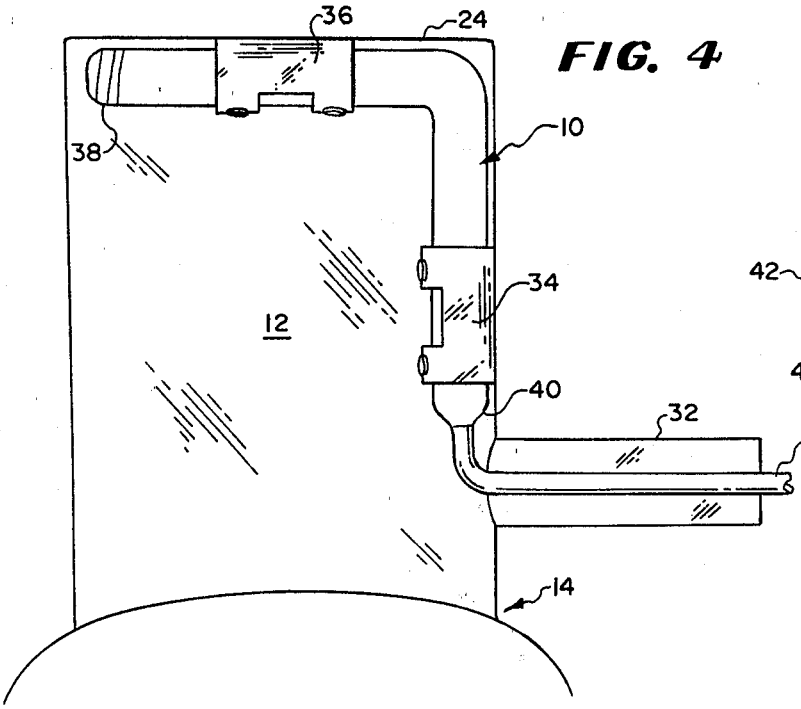
FIG. 4 is a side sectional view of the hood and air flow baffle of FIG. 3 taken along the line 4—4 therein.

Referring now to FIG. 4, the baffle 10 may be secured and sealed at an outer or termination end 38 by tape, heat shrink tubing or tape. A first end 40 of the baffle also is taped or otherwise secured to the outside of the tubing 26 to complete the air flow baffle or manifold 10. The baffle 10 operates at about 70 decibels at 15 cfm.

Figure 5:
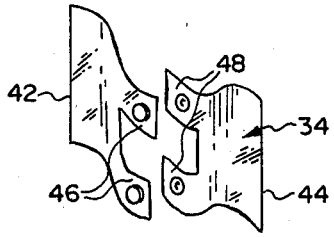
FIG. 5 is a perspective enlarged view of one air flow baffle retainer.

Referring to FIG. 5 one of the snap type retainer clips, here 34, is shown removed from the hood 12. The clip typically may be made of plastic and is sealed along a pair of outer edges 42 and 44 to the hood or otherwise secured to the hood 12. A pair of inner snap tabs 46 and 48 are engaged with one another to secure the air flow baffle 10 therein.

Figure 6:
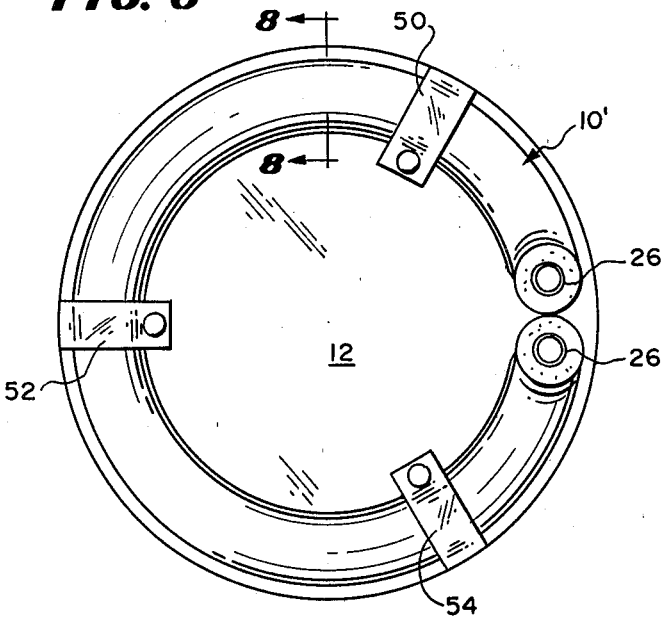
FIG. 6 is a top view of a second embodiment of the air flow baffle of the invention.

A second embodiment of the air flow baffle 10' is illustrated in FIG. 6, which may be secured by the retainers 34 and 36 or may be secured by a plurality of retainer tabs 50, 52 and 54. The particular type of retainer tab or clip is not critical to the invention. In the embodiment of the baffle 10' shown in FIG. 6, the air line tubing and baffle is formed in the shape of a circular ring or donut which allows the air flow to sweep down along the interior sides of the hood 12 to keep the hood from fogging and to provide a more even air flow over the head of the worker. The tubing 26 may extend through the outer baffle end 38 and be secured to itself near the first baffle end 40 which may then be clipped or otherwise secured to the hood 12. The entrance for the air line or tubing 26 in the embodiment of FIG. 6 may be at the back of the worker's head through the air line sleeve 32, as before illustrated, or may be at the top of the hood if desired.

The donut-type baffle 10' works at an increased air flow efficiency and may operate at lower noise levels below the 70 decibel level of the baffle 10. Also the donut shape allows the worker to wear a hard hat without decreasing the stability of the hood.

Figure 7:
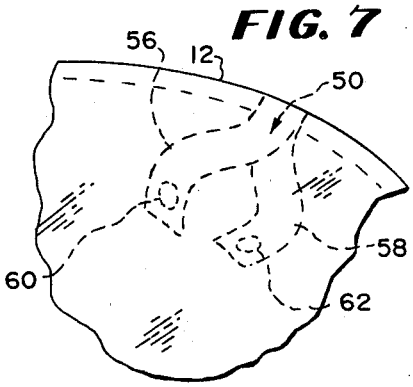
FIG. 7 is a partial perspective view showing one retainer tab of FIG. 6 without the air flow baffle.

FIG. 7 illustrates one of the retainer tabs 50, which includes a pair of arms 56 and 58 which are snapped together by a mating pair of snaps 60 and 62 on the outer end of the arms. The baffle 10' is secured therebetween.

Figure 8:
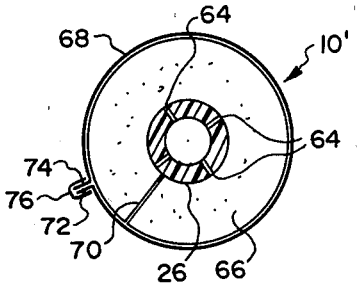
FIG. 8 is a sectional view through the air flow baffle of FIG. 6 taken along the line 8—8 therein.

FIG. 8 is sectional view of the baffle 10' taken along the line 8—8 in FIG. 6, but is also representative of the baffle 10 illustrated in FIGS. 1–4. The tubing 26 has a plurality of openings 64 therein, which are covered by a foam layer 66. The layer 66 is sealingly engaged against the tubing 26, preferably by a cloth cover 68. The cover 68 compresses the foam layer 66, which can be a sheet of urethane foam wrapped therearound, so that air must exit through the foam and not through a seam 70 or other cracks in the foam layer 66. The cover 68 has a pair of free edges 72 and 74 which are sewn or otherwise secured together. The edges 72 and 74 then preferably are covered by a binding cover 76 which prevents the edges from fraying. The binder cover 76 can be tape or cloth of the same type as the cover 64 which can be glued, heat sealed, sewn or otherwise secured to the cover 64.

Figure 9:
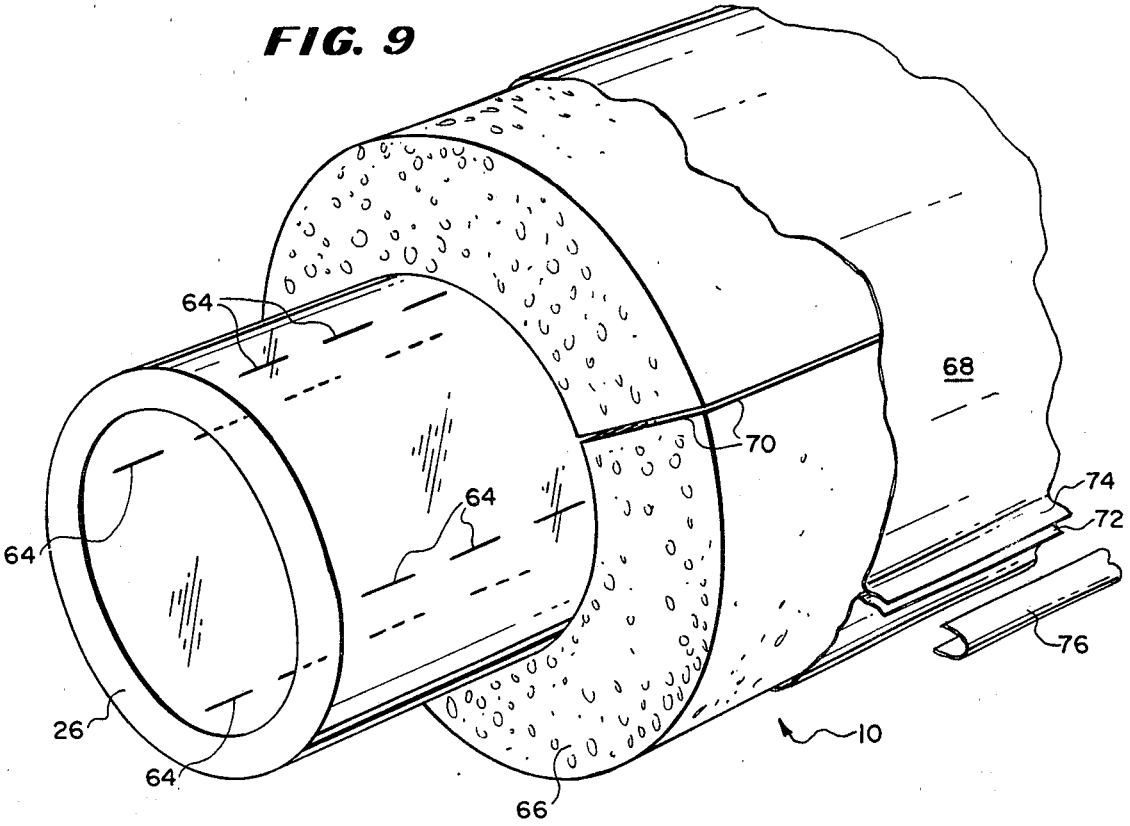
FIG. 9 is an enlarged partially sectional perspective view of the air flow baffle construction.
Figure 10:
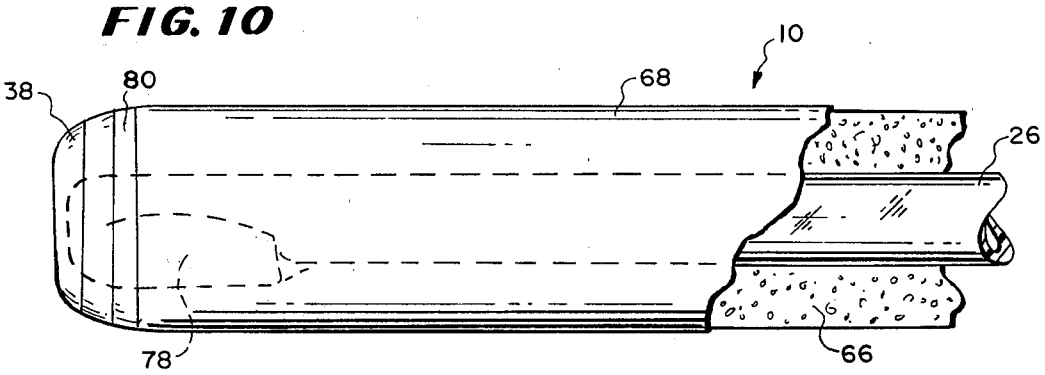
FIG. 10 is an enlarged partially sectional side plan view of the air flow baffle.

Referring now to FIGS. 9 and 10, further details of one form of the openings 64 and the baffle end 38 are best illustrated. The openings 64 are slits spaced 90° circumferentially around the tubing 26, four rows being illustrated. Typically, the openings whether slits or holes are punched out through the tubing 26 which is a polyvinyl chloride material. The slits 64 are 3/16 inch slits spaced 5/16 inches apart along the length of the baffle 10 or 10'. The tubing 26 has a 5/16 inch inner diameter and a 7/16 inch outer diameter. The baffle end 38 can be formed by doubling a free end 78 of the tubing 26 back upon itself and then sealing the end 38 with a layer of tape 80, such as so-called electrician tape, heat shrink tape or tubing. The foam layer can be formed from ½ inch urethane foam having a density of two pounds per cubic foot.

The above described air flow baffles 10 or 10' operate at about 70 decibels at 15 cfm, which is significantly below the NIOSH maximum of 80 decibels, with a high air flow efficiency allowing safe operation of respirators with low air supply pressures. The term "respirator" as utilized herein includes any wearing apparel having an air flow requirement and contaminent protection requirement. The ability to increase the air flow in a respirator without increasing the operating noise level allows the respirator to have a greater operating safety factor. The safety factor is determined by the respirator pressure and the amount of contaminents allowed into the respirator, such as a full body suit, per volume of air supplied. The baffle of the invention thus applicability to any air inlet and not just into a headpiece. The air flow baffles 10 and 10' are also removable from the respirators for reuse.

Many modifications and variations of the present invention are possible in light of the above teachings. The particular sizes and shapes of the various components such as the baffles 10 and 10', tubing 26 and openings 64 therein can be varied within the scope of the invention. For instance, the openings 64 can be circular apertures about ⅛ inch in diameter circumferentially spaced around the tubing 26 and spaced about two inches apart along the length of the baffle 10 or 10' depending upon the flow rate desired. The type of polyvinyl chloride is not critical and the respirator 14 and the hood 12 can be of numerous configurations as well as portions of other type of wearing apparel. It is, therefore, to be understood that within the scope of the appended cliams, the invention can be practiced otherwise than as specifically described.

What is claimed and desired to be secured by Letters Patent of the United States is:

1. An improved supplied air respirator adapted to be connected to a source of air, said respirator, said comprising a hood adapted to fit over the head of a user and having at least one clear portion adapted to be positioned over the eyes of the wearer which portion is capable of fogging improvement comprising:

air flow baffle means detachable from the respirator and adapted to supply air from the air source into the interior of the respirator and including means for increasing the air flow efficiency without increasing the operating noise level of said baffle means;

said air flow baffle means are adapted to be detachably secured on the inside surface of said respirator, said baffle means including an air flow distribution member shaped and adapted to direct air into at least one portion of said respirator; and said air flow baffle means include a flexible tubing having a plurality of lateral openings along the circumference and length thereof and a foam layer sealingly engaged around said length covering said openings, said foam layer substantially uniformly surrounding said tubing along said length thereof and a porous material binding secured around said layer, said binding compressing said layer to eliminate any gaps in said layer and to protect said foam layer.

2. The respirator of claim 1 wherein:

said hood includes a top surface which is capable of fogging, and said air flow baffle means is adapted to be detachably secured on the top inside surface of said hood, said baffle means including a substantially circular air flow distribution member adapted to direct air flow from the top of said hood along the inside surfaces of said hood to prevent fogging of said clear portion.

3. The respirator of claim 1 wherein:

said air flow baffle means operates at approximately 70 decibels at 15 cubic feet per minute.

4. The respirator of claim 1 wherein said porous binding is cloth.

* * * * *